United States Patent [19]

Aulbers et al.

[11] Patent Number: 4,972,694

[45] Date of Patent: Nov. 27, 1990

[54] LOCK WITH AN ELECTROMECHANICAL RELEASE MECHANISM

[75] Inventors: Antonius P. Aulbers; Johannes M. Ewalds, both of Delft; Paul I. d'Hond, Zwijndrecht; Johan C. Hordijk, Oosterhout, all of Netherlands

[73] Assignee: Chubb Lips Nederland bv, Dordrecht, Netherlands

[21] Appl. No.: 508,394

[22] Filed: Apr. 10, 1990

[30] Foreign Application Priority Data

Apr. 13, 1989 [GB] United Kingdom ..... 8908386
Jul. 17, 1989 [GB] United Kingdom ..... 8916298

[51] Int. Cl.[5] ..... E05B 47/00
[52] U.S. Cl. ..... 70/277; 70/278
[58] Field of Search ..... 70/277, 278, 276, 280, 70/281, 282

[56] References Cited

U.S. PATENT DOCUMENTS 4,457,148 7/1984 Johansson ..... 70/278
4,653,687 1/1987 Fane ..... 70/276
4,802,353 2/1989 Corder ..... 70/277
4,807,455 2/1989 Mauer ..... 70/277

FOREIGN PATENT DOCUMENTS 148701 7/1985 European Pat. Off. .
228027 5/1989 European Pat. Off. .
3643388 6/1988 Fed. Rep. of Germany .

*Primary Examiner*—Robert L. Wolfe
*Attorney, Agent, or Firm*—Jerry A. Miller

[57] ABSTRACT

An "electronic" lock has a thrower with a radial lug for extending and retracting the bolt when turned by a key carrying a proper code. Turning of the thrower through a sufficient distance to shift the bolt is normally blocked by a dogging lever with which the thrower lug abuts. The thrower lug also sweeps a cam track on a second lever so as to pivot the latter during initial turning movement of the thrower away from its rest position. The second lever carries an electromagnet. While the electromagnet remains de-energized there is no interaction between the two levers so that the second lever can pivot independently of the first and turning of the thrower remains limited. When a correct key code is detected, however, the electromagnet is energized to hold the two levers together. Initial turning of the thrower thereby causes the second lever to carry the dogging lever away from its blocking position and thus free the thrower for 360° movement.

7 Claims, 4 Drawing Sheets

LOCK WITH AN ELECTROMECHANICAL RELEASE MECHANISM

BACKGROUND

The present invention relates to locks and more particularly to "electronic" locks of the kind comprising means for detecting a code presented to the lock; a bolt retractable by the turning of an associated rotatable member (termed herein "thrower"); and an electromechanical release mechanism which normally blocks turning of the thrower, at least to the extent sufficient to retract the bolt, but which permits such turning in response to the detection of a proper code. The invention is especially concerned with locks of this kind for use where the code is carried by portable tokens shaped to resemble and functionally equivalent to conventional keys (and termed as such throughout this specification) but where the code is borne in a form to be detected by electronic rather than purely mechanical means. The invention may, however, also find utility where the code entry is accomplished by means other than "keys", of which examples are given hereinafter.

Locks of the kind stated are well known, at least in the patent literature, and have been proposed in conjunction with diverse methods of electronic key code detection. Some examples are described in United Kingdom patent applications Nos. 2024922, 2055951, 2139689 and 2166484 and European patent application no. 0293137. In these examples the electromechanical release mechanism invariably comprises a solenoid which is adapted to move an abutment into or out of its blocking position in accordance with the state of energization of the solenoid. A solenoid moving an abutment is not, however, by any means the ideal choice of control element particularly when space and power-consumption are at a premium (as, for example, in the case where the release mechanism is to be run from an associated self-contained battery supply from which a long service life is expected) and an aim of the invention is to provide a lock of the kind stated with a secure and compact release mechanism which is capable of operation with a significantly lower consumption of electrical power than a comparable solenoid-driven mechanism.

From European patent application no. 0228027 there is known an electromechanically-released lock for a safety deposit box where the release mechanism includes a stationary electromagnet rather than a solenoid moving an abutment. The armature for the magnet is carried at one end of a lever which is in turn pivoted to a blocking element for the bolt. A spring normally biases the lever to pivot the armature into contact with the magnet and operation of a handle to withdraw the bolt tends to pivot the lever on the blocking element in the opposite sense. While the magnet is not energized, operation of the handle pivots the armature away from the magnet until movement of the handle is itself blocked by the blocking element. When the magnet is energized, however, the armature is held stationary upon it by magnetic attraction and pivoting of the lever by the handle causes the lever to lift the blocking element to its releasing position, about the fulcrum represented by the armature, against the force of the spring. Although the electromagnet is not required to cause movement of any other element in this mechanism it must apply a substantial attraction force to the armature to resist the forces tending to pivot the armature away during the movement of the blocking element to its release position, and is therefore still likely to consume a significant amount of power. This mechanism may also be susceptible to compromise by manipulation or vibration and will be rendered ineffective to prevent retraction of the bolt if the armature should become stuck to the magnet (e.g. through freezing or by means of a deliberate attack). It is also geometrically unsuited to a lock with a rotary thrower.

SUMMARY OF THE INVENTION

Accordingly, in one aspect the present invention resides in a lock comprising a bolt retractable by the turning of an associated thrower; means for detecting a code presented to the lock; and an electromechanical release mechanism which normally blocks turning of said thrower, at least to the extent sufficient to retract the bolt, but which permits such turning in response to the detection of a proper code; said mechanism comprising: a first movable element having an abutment to block turning of the thrower and normally lying in its blocking position; a second movable element normally uncoupled from the first and arranged to be moved with at least an initial turning movement of the thrower away from its rest position; and an electromagnet carried by one of said first or second movable elements which when energised can hold the first said element to the second said element so that said movement of the second element carries the first element away from its blocking position; energization of said electromagnet occuring in response to the detection of a proper code.

In this arrangement, therefore, the power to move the said first movable element away from its blocking position comes from the user turning the thrower, the electromagnet being required merely to hold the two elements together during this movement and consequently requiring considerably less—typically an order of magnitude less—electrical power to accomplish this task than would be required by a solenoid arranged to drive the same element through the same distance. Furthermore, the two movable elements are effectively coupled together only when the electromagnet is energised and its required attraction force, and consequently its power consumption, may also be considerably less than that required by the mechanism of EP-A-No. 0228027.

The aforesaid first and second movable elements may comprise respectively first and second levers pivoted in parallel on axes offset from the axis of the thrower. In a preferred embodiment of this arrangement, with the thrower formed with a radial lug for retraction of the bolt, the first lever is formed with an abutment to intercept said lug when in its blocking position, the second lever is formed with a cam track, and the lug of the thrower is configured to sweep said cam track whereby to pivot the second lever through an initial turning movement of the thrower away from its rest position and thereby pivot said abutment of the first lever clear of the lug when the electromagnet is energized.

In a key-operated embodiment of the invention, the lock will comprise a rotatable barrel defining a keyway to receive and be turned by a proper key; means associated with the keyway to detect a code borne by the key and means to energize the electromagnet in response to the detection of a proper key code; and means for establishing a rotary driving connection between the barrel and the thrower.

The same electromechanical release mechanism could, however, equally be employed in a lock where the code input and turning of the thrower is effected otherwise than by means of a "key". Thus, for example, a code could be presented to the lock by appropriate actuation of a numbered keypad or similar push-button device; the code could be borne upon a card or other data carrier e.g. in the form of a magnetic stripe, or a bar code or other optical (including holographic) markings, to be detected by an appropriate reading device associated with the lock; or the code could be constituted by a fingerprint, retinal pattern or other respective biometric parameters of the authorised users, again to be detected by an appropriate reader associated with the lock; and the thrower could be turned by simple manipulation of a handle, knob or the like accessible member after presentation of the code.

BRIEF DESCRIPTION OF THE DRAWINGS

Preferred features of the present invention will now be more particularly described, by way of example, in conjunction with the accompanying drawings in which.

DETAILED DESCRIPTION OF THE INVENTION

Figure 1:
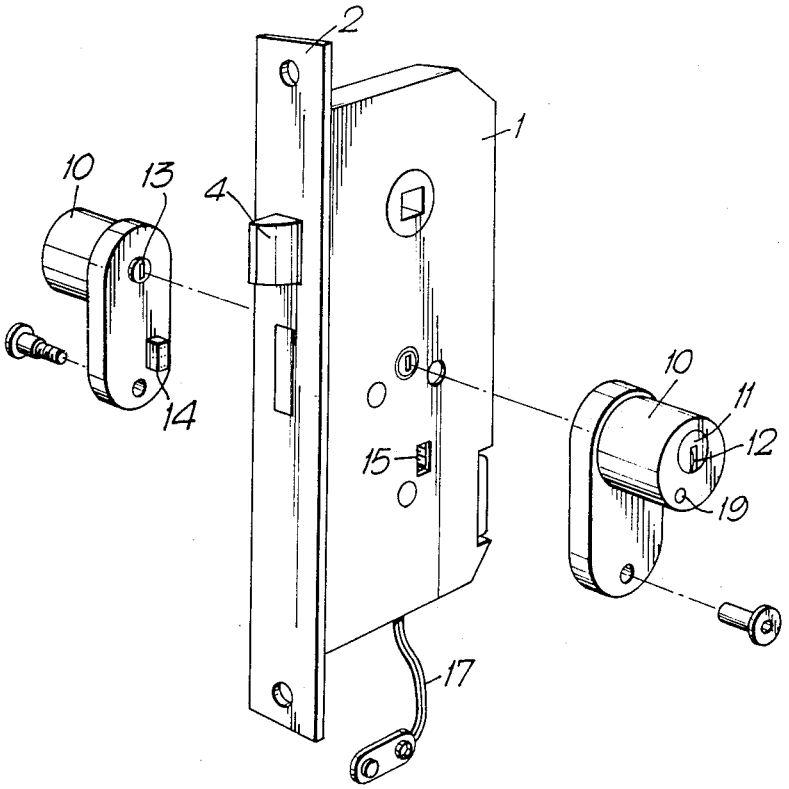
FIG. 1 is an external view of one embodiment of an electronic key-operated door lock in accordance with the invention.
Figure 2:
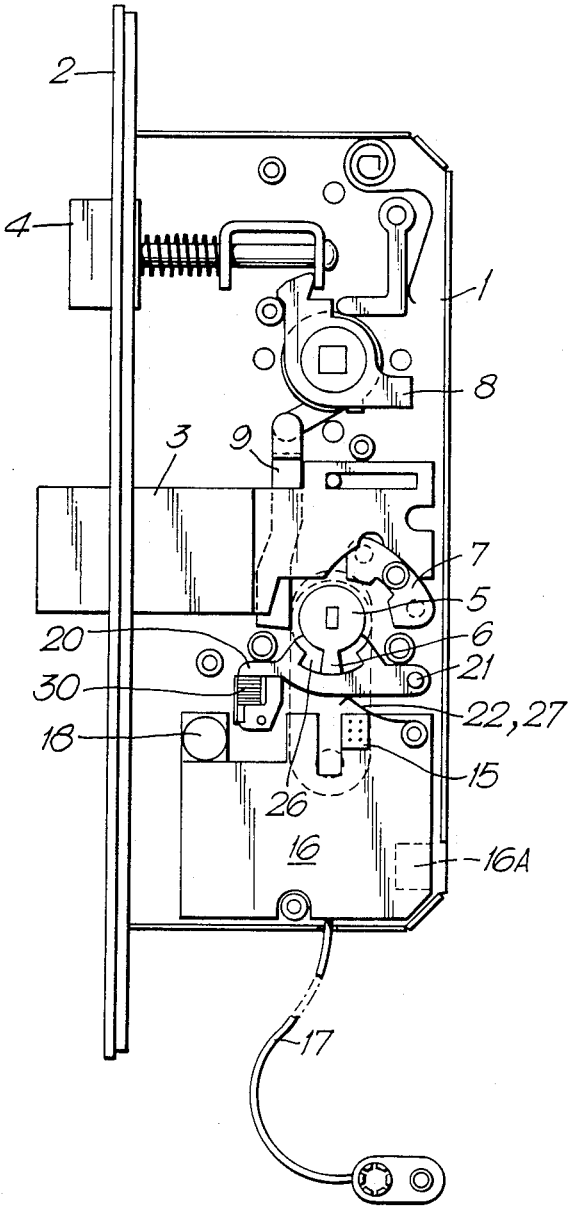
FIG. 2 is an interior view of the lock of FIG. 1.

With reference to FIGS. 1 and 2 the illustrated lock is of mortice style having a casing 1 and a forend 2 through which extend a deadbolt 3 and a latch bolt 4. Extension and retraction of the dead bolt 3 is in response to rotation in an appropriate sense of an internal thrower 5 having a radial lug 6 which drives the bolt through the agency of a runner 7 moving along an arcuate track, the geometry of the runner/bolt relationship being such as to deadlock the bolt against end pressure when thrown. Retraction of the latch bolt 4 is in response to the turning of a cam 8 by means of external handles (not shown) and is likewise accomplished, via a linkage 9, by rotation of the thrower 5 to withdraw the dead bolt. As thus far described, the mechanism is of conventional design much practised by the assignee of the present applicants.

Mounted externally to respective sides of the lock case 1 are a pair of cylinder units 10. Each such unit has a rotatable barrel 11 with a keyway 12 and, at its inner end, a drive socket 13 whereby to turn the thrower 5. Associated with the keyway in each cylinder unit 10 are means for electronically transducing a code signal from a proper key when inserted therein. In principle, any known form of electronic key code recognition could be employed although in a preferred embodiment of the illustrated lock code transduction is by way of an inductively-coupled transponder method e.g. as described in International patent application no. W088/03594. In any event, when a coded key is inserted into either keyway 12 its code signal is transmitted via a plug connector 14 in the rear of the cylinder unit and a respective socket 15 in the lock case to a PCB 16 inside the lock which mounts the processing electronics which serve to determine if the key code is valid, and if so the release mechanism to be described below is actuated to permit rotation of the thrower 5 when the key is turned.

As an alternative to the internal processor 16 there may be a connection 16A to a remotely located central processor e.g. where the lock is part of an overall access-control system for a building.

Electrical energy for the internal electronics and for the release mechanism is supplied via a lead 17 from a battery pack (not shown) housed in another mortice in the door. In the unlikely event of power failure (the lock will have a low battery level warning circuit sounding a buzzer 18) an emergency supply can be connected through a normally sealed socket 19 in the face of either cylinder unit 10.

Figure 3A:
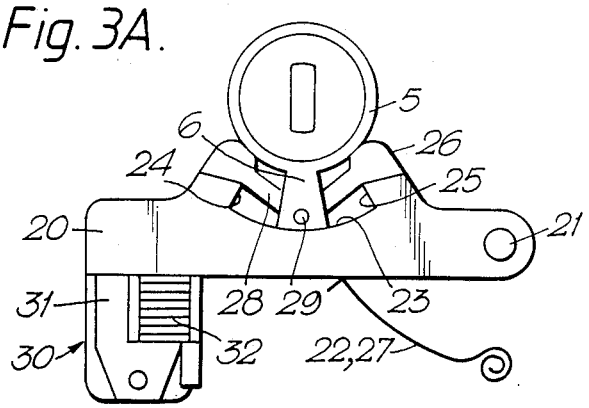
FIGS. 3A, C show the electromechanical release mechanism of the lock in different phases of operation.
Figure 3B:
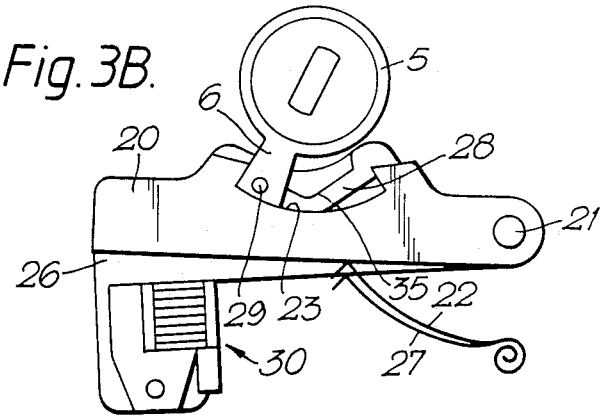
Figure 3C:
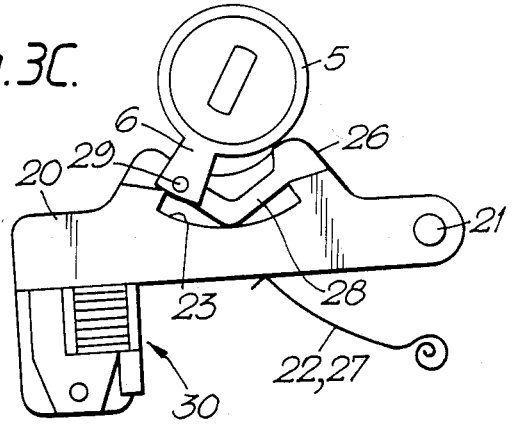

Description will now be directed to the electromechanical release mechanism for the lock, which is also shown to a larger scale in FIGS. 3A–C.

A dogging lever 20 is pivoted on a pin 21 inside the lock case and biased upwards against the thrower lug 6 by a spring 22. This lever has an arcuate cut-out 23 within which the lug 6 normally lies and if an attempt is made to turn the thrower 5 from its rest position of FIG. 3A with an incorrectly-coded key or some other implement the lug 6 will be arrested after an initial turning movement in either direction by an abutment face 24 or 25 at the end of the cut-out. The latter condition is shown in FIG. 3B. Thus the lever 20 normally serves to block rotation of the thrower 5 through a sufficient angle to shift the dead bolt 3 in either direction.

A second lever 26 is also pivoted on the pin 21 and biased upwardly by a spring 27. This lever has a V-shaped cam track 28 formed in one of its flanks within which is received a pin 29 carried by the thrower lug 6. The effect of the pin 29 in the track 28 is therefore to cam the lever 26 downwards from the follower 5 against the bias of the spring 27 when the follower is turned. The main part of this cam lever 26 is made from an engineering plastics material, e.g. Delrin (trade mark), or from a non-magnetic metal alloy such as Mazak (trade mark). However, it also carries an electromagnet 30 which in the illustrated embodiment has a U-shaped core 31 with an energizing coil 32 wound around one of its legs. In the rest position of the mechanism shown in FIG. 3A the ends of the legs of the electromagnet core lie against an edge of the dogging lever 20, which latter member is made of ferro-magnetic material (or at least it carries an armature of such material where contacted by the electromagnet).

So long as the electromagnet 30 remains de-energized there is no magnetic interaction between the levers 20 and 26 and so if an attempt is made to turn the thrower 5 the lever 26 will initially be cammed downwardly but the lever 20 will remain in place to block further movement of the thrower, i.e. as shown in FIG. 3B. When a valid key code is detected by the processor, however, the electromagnet 30 is energised and thus generates an attractive force holding the lever 20 to the core 31. When the thrower 5 is now turned, therefore, the cam lever 26 takes the dogging lever 20 with it when it pivots downwards, permitting the thrower lug to clear the end of the cut-out 23 as shown in FIG. 3C and continue a 360° revolution so as to shift the bolt 3. As the pin 29 clears the end of the track 28 the two levers pivot back under their combined spring biases and the whole mechanism is reset to the FIG. 3A position as the thrower completes its rotation.

If an attempt is made to force the thrower 5 round while the electromagnet 30 is de-energized the magnet will not itself be loaded and the force will be resisted by the more robust lever 20. To relieve that lever from an extreme force there may be a shear pin between the thrower 5 and barrels 11 which will break the coupling in the event of the application of a torque greater than a predetermined value.

From the above description it will be appreciated that the force to move the levers of the release mechanism comes from the user turning the key and that the electromagnet 30 need only generate sufficient force to carry the lever 20 with the lever 26 against the bias of the spring 22; being in contact with the magnet core to start with the lever 20 is in the position of maximum attraction. The power required for energization of the electromagnet 30 is, therefore much less than would be required for example by a solenoid which had to drive the lever 20 through the same distance to clear the thrower lug 6, by itself. By way of example the electromagnet in a mechanism constructed as illustrated herein where the force required to carry the lever 20 is approximately 1 Newton draws only around 20 milliamps from a 4.5 v supply whereas a solenoid to move the same lever through 3 mm would require approximately 500 milliamps starting current and at least 150 milliamps holding current. The solenoid would also be bulkier and more expensive. Another advantage of the minimal current requirement of the electromagnet, in addition to minimising the overall power consumption of the operation, is that it is low enough to be supplied directly through the microelectronics of the internal processor on the PCB 16 (if applicable), i.e. without the interposition of a relay.

In practice, energization of the electromagnet 30 after detection of a valid key code will be for a limited period of time under the control of the processor, sufficient for a normal user to have turned the thrower lug 6 past the end of the cut-out 23 before de-energization, say 8 seconds. As a further aid to power conservation, however, the lock may also comprise a microswitch or other sensor to detect when the thrower has reached that position and to de-energize at that point if the pre-set time has not elapsed. If perchance a particularly fast user should manage to turn the inserted key before the processor has identified the key code and energized the electromagnet, i.e. so the FIG. 3B condition is then reached, he need simply return the key to the central position of FIG. 3A whereupon the magnet will pick up the lever 20 and normal operation will then follow when the key is turned again, i.e. it is not necessary to withdraw and re-insert the key.

Figure 4:
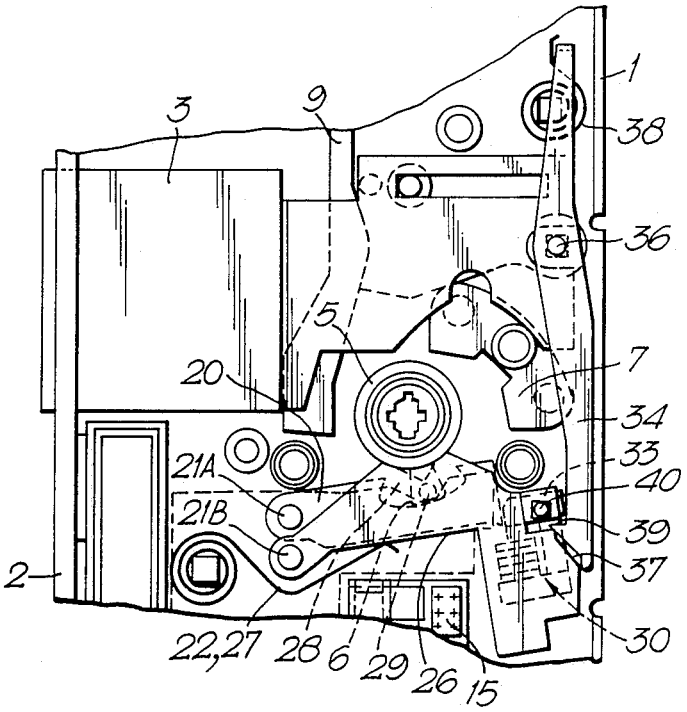
FIG. 4 is a partial interior view of a lock with a second embodiment of release mechanism.
Figure 2:
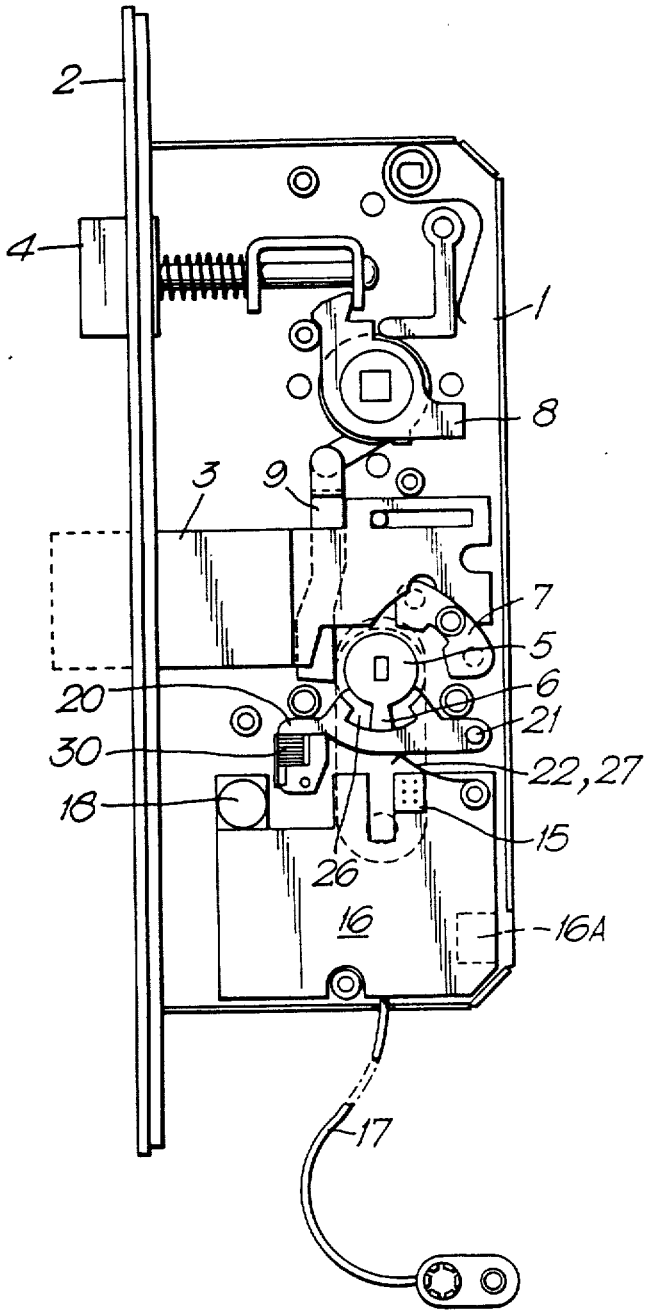

Turning now to FIG. 4 this shows a second embodiment of the release mechanism where like parts are denoted by the same reference numerals as in the preceding Figures. In this case, however, the two levers 20 and 26 are pivoted on respective spaced-apart pins 21A and 21B. The effect of the different arcs of movement of the levers is that when the electromagnet 30 is energized and the two levers both pivot there is also a component of sliding movement between the contacting surfaces of the magnet core 31 and the lever 20—in this case shown with a separate armature 33. This movement may be of advantage firstly in preventing the mechanism becoming insecure by the two levers freezing or otherwise becoming bonded together, either in cold weather or as a result of a deliberate attempt to move the lever 20 by the lever 26 without a proper key; either this movement will break any such bond or if it does not then the levers will jam and not pivot sufficiently far to release the thrower 5. Secondly, this movement has a cleaning action on the surfaces and helps to maintain a good magnetic contact therebetween.

FIG. 4 also shows an additional detent lever 34 which serves to increase the physical security of the release mechanism e.g. against attempts to shake the dogging lever 20 out of its blocking position by way of impacts delivered to the lock in the vertical sense, or other such manipulation. It will be noted that the cam track 28 in the magnet lever 26 has an upper as well as a lower bounding surface in its central region, indicated at 35 in FIG. 3B. While the thrower 5 is in or adjacent to its central position, therefore, the lever 26, and hence also the lever 20, is positively prevented from being forced downwards far enough to release the lug 6 so as to shift the lock bolts, by virtue of the engagement of the lever surface 35 with the thrower pin 29. At the extremities of the permitted movement of the thrower lug 6 within the cutout 23 of lever 20, however, e.g. in the position of FIG. 3B, the surface 35 must be terminated and hence in this position of the embodiment of FIG. 3 downward forcing of the levers would be resisted only by their springs 22, 27, which may be considered insufficient.

Returning to FIG. 4, the additional lever 34 is pivoted on a pin 36 and biased into engagement with a tapered nose surface 37 of the lever 26 by a spring 38. If the thrower 5 is now turned without the proper key, i.e. without energization of the magnet 30, the lug 6 will be turned to either end of the cut-out in lever 20 and at the same time, of course, the lever 26 is cammed downwardly away from lever 20. The movement of nose 37 of lever 26 thereby permits the lever 34 to pivot inwards and place its abutment surface 39 beneath a peg 40 carried by the lever 20, thus positively blocking the latter from any thrower-releasing movement. When the thrower is subsequently returned to its central position the lever 26 returns to its undisplaced position and resets the lever 34 to the position of FIG. 4. When the two levers 26 and 20 pivot together with the magnet 30 energized during authorised operation of the lock the peg 40 will clear the surface 39.

We claim:

1. A lock comprising: a bolt; a rotatable thrower for retracting said bolt; means for detecting a code presented to the lock; an electromechanical release mechanism which normally blocks turning of said thrower, at least to the extent sufficient to retract the bolt, but which permits such turning in response to the detection of a proper code; said release mechanism comprising: a first movable element having an abutment to block turning of the thrower and normally lying in its blocking position; a second movable element normally uncoupled from the first and arranged to be moved with at least an initial turning movement of the thrower away from its rest position; and an electromagnet carried by one of said first or second movable elements which when energised can hold the first said element to the second said element so that said movement of the second element carries the first element away from its .blocking position; and means for energizing said electromagnet in response to the detection of a proper code.

2. A lock according to claim 1 wherein said first and second movable elements comprise respectively first and second levers pivoted in parallel on axes offset from the axis of the thrower.

3. A lock according to claim 2 wherein the thrower is formed with a radial lug for retraction of the bolt; said first lever is formed with an abutment to intercept said lug when in its blocking position; said second lever is formed with a cam track; and said lug of the thrower is configured to sweep said cam track whereby to pivot said second lever through an initial turning movement of the thrower away from its rest position and thereby pivot said abutment of the first lever clear of the lug when said electromagnet is energized.

4. A lock according to claim 3 wherein said cam track is formed with a surface configured to abut a portion of said lug to prevent forced displacement of the second lever at least when the thrower is in its rest position, and the second lever is configured to prevent forced displacement of the first lever in that position.

5. A lock according to claim 3 further comprising a detent member controlled by the position of the second lever such that when the latter is pivoted by said initial turning movement of the thrower but the electromagnet is not energized the detent member is moved to engage the first lever to prevent forced displacement thereof.

6. A lock according to claim 2 wherein the first and second levers are pivoted on axes offset from one another whereby to impart a component of sliding movement between the electromagnet and the surface of the respective lever which it attracts when the electromagnet is energized and the levers are moved.

7. A lock comprising:

a bolt;

a rotatable thrower with a radial lug for retracting said bolt;

a rotatable barrel defining a keyway to receive and be turned by a proper key;

detecting means associated with said keyway to detect a code borne by the proper key;

means for establishing a rotary driving connection between said barrel and said thrower;

a first lever having an abutment and normally lying in a position in which said abutment blocks said lug from turning beyond an initial angle from the rest position thereof;

a second lever normally uncoupled from the first lever and formed with a cam track which said lug is configured to sweep whereby to pivot said second lever during the turning of said lug through said initial angle; an electromagnet carried by one of said first or second levers; and means for energizing said electromagnet in response to the detection of a proper key code by said detecting means; whereby when said electromagnet is energized it can hold said first and second levers together so that turning said lug through said initial angle is effective to pivot both of said levers and thereby move said abutment clear of the path of the lug.

* * * * *

PRINTER'S TRIM LINE

UNITED STATES PATENT AND TRADEMARK OFFICE

CERTIFICATE OF CORRECTION

PATENT NO. : 4,972,694

DATED : November 27, 1990

INVENTOR(S) : Aulbers, et al.

It is certified that error appears in the above-identified patent and that said Letters Patent is hereby corrected as shown below:

Fig. 2 should be deleted to appear as shown on attached sheet.

Signed and Sealed this

Fourth Day of August, 1992

*Attest:*

DOUGLAS B. COMER

*Attesting Officer*

*Acting Commissioner of Patents and Trademarks*